United States Patent [19]

Powell

[11] Patent Number: 4,477,500

[45] Date of Patent: Oct. 16, 1984

[54] EYE INSERT FOR TAXIDERMY FORM

[76] Inventor: Leon T. Powell, Rte. 13, Box 52, Salisbury, N.C. 28144

[21] Appl. No.: 481,778

[22] Filed: Apr. 4, 1983

[51] Int. Cl.[3] ..... A63H 3/38

[52] U.S. Cl. ..... 428/16; 428/542.4; 434/296; 446/343; 446/392

[58] Field of Search ..... 46/165, 166, 167, 168, 46/169 R, 169 A, 169 B, 170; 428/16, 542.4; 434/295, 296

[56] References Cited

U.S. PATENT DOCUMENTS 1,432,704 10/1922 Lichtenstein ..... 46/165 X

FOREIGN PATENT DOCUMENTS 539374 4/1957 Canada ..... 46/169 A 191954 1/1923 United Kingdom ..... 46/165

*Primary Examiner*—Henry F. Epstein

[57] ABSTRACT

An eye insert (15) is disclosed and claimed for a taxidermy form (10) having eye sockets (11). An eye insert (15) is positioned within each eye socket (11) and cooperates to automatically align eye insert (15) to an anatomically correct position and appearance. Eye insert (15) includes an artificial eyeball (16) and a base (20) into which eyeball (16) is adapted to be partitially set. Base (20) is configured to be positioned within eye socket (11) and fixed against substantial adjustment. Alignment means are carried by base (20) and eye socket (11) for positioning base (20) in a pre-determined alignment in eye socket (11) within a narrow range of adjustment.

9 Claims, 7 Drawing Figures

FIG. 4
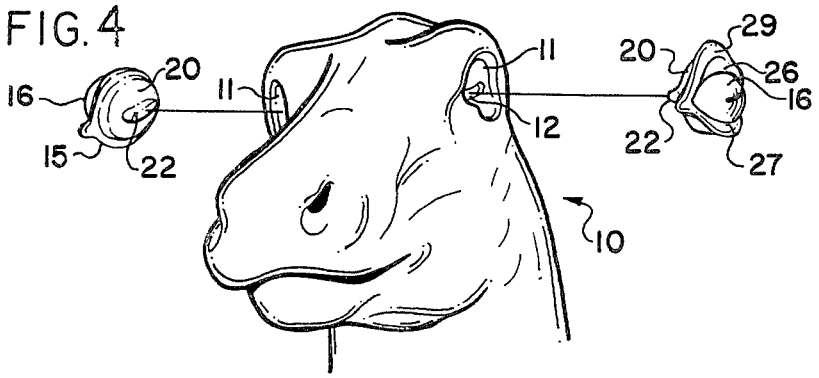
FIG. 5
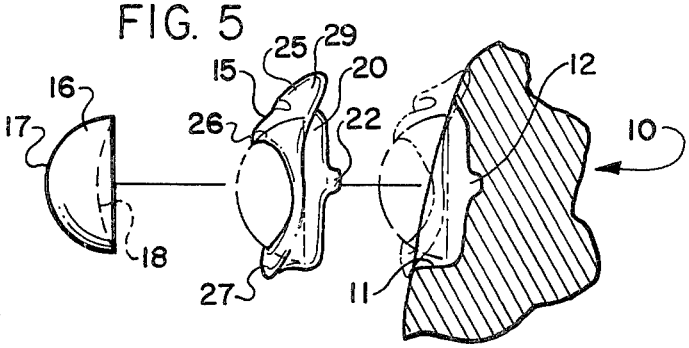
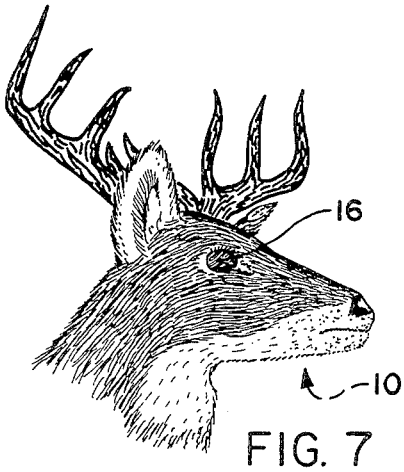
FIG. 7
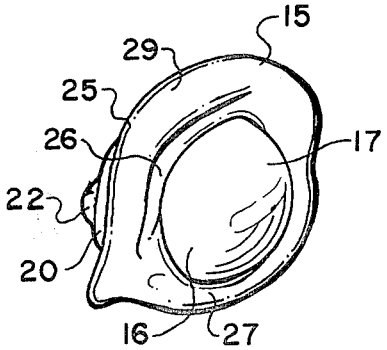
FIG. 6

EYE INSERT FOR TAXIDERMY FORM

TECHNICAL FIELD AND BACKGROUND OF THE INVENTION

This invention relates to an eye insert for a taxidermy form and to a taxidermy form having a preformed eye socket and an eye adapted for automatic alignment to an anatomically correct position and appearance.

The particular disclosure of this application is a taxidermy form of a white tail deer and an eye insert adapted for use with the form. However, the invention described in this application is equally adaptable to taxidermy forms of many other game species.

Conventionally, the head of a taxidermy form contains eye sockets of the approximate size present in the skull of the corresponding animal. These sockets are, of course, much larger than the eye itself which in the live animal is positioned in the socket and held in place by various muscles and a protective cushion of connective tissue including the lids and brow. Therefore, when modeling a taxidermy form to look lifelike and realistic, the eye must be set within this enlarged eye socket in a very correct and precise manner. Ordinarily, the eyes are set in clay or some other modeling material. This procedure must be done far enough ahead to allow for hardening of the material before the animal skin, referred to as the "cape," is applied to the form.

Proper setting of the eyes is extremely important to produce a natural looking mount. First, the center line of the eye pupil on each side rim of the eye socket must be determined. Then, the eye socket is partially filled with clay or mache and a glass eye having a convex outer surface and a concave inner surface is pressed into the socket and embedded into the modeling material. The glass eye must be adjusted so the eye represents a line of vision of approximately 45° from the front. The eye must also be tipped downwardly slightly so that the line of vision is slightly below the horizontal. The degree of tipping necessary varies from one species to another. The downward tip of the glass eye should bring the pupil into the center of the eye opening at the widest point when the eyelids are later applied.

The eye must be adjusted so that it is the correct distance from the front and bottom rim of the eye socket. Then it is pressed further into the modeling compound until the outermost point overhangs or protrudes from the bottom rim of the eye socket by approximately ¼ inch (0.6 cm). At this point, the eye depth and angle of the form relative to the outermost point of the eye must be determined. The distance from the front of the socket rim to the eye must again be checked to make sure it has not changed as the eye was pressed further into the modeling compound.

Rolls of clay are then placed above and below the eye to form a base for the eyelids. A great deal of skill is required to sculpt the eyelids since the modeling compound forms the foundation for the cape around the eyes. Finally, the eye opening with the lids in place must be checked to make sure that they extend the proper distance in all four directions from the center point of the eyeball. Not only must both eyes be carefully prepared to look realistic, but both eyes must be prepared substantially identically from one side to the other so that the form, when completed, is symmetrical.

From the foregoing, it is apparent that proper placement of an artificial eye in a taxidermy form is a complex procedure which requires a great deal of experience to perform properly and consistently. Because of the relatively large size of the eye socket, there is a great deal of room for variation in placement of the eye. Therefore, despite the best efforts of the taxidermist, results can vary from form to form, or even from one eye socket to the other on a single form. Even for a very experienced taxidermist, the procedure of properly setting and molding the eye into the socket can take several hours. In addition to the time required to carry out the procedure, further delay results if the modeling compound is allowed to dry before the cape is applied to the form.

Because of these disadvantages, some forms are now provided with preset eyes. The eyes are permanently molded into each form so that the taxidermist merely applies the cape to the form and glues it into place around the preformed eye. While this development does save a considerable amount of time over the conventional method, it nevertheless deprives the taxidermist of a great deal of flexibility in preparing each mount. Because the eyes are permanently preset into the sockets, no further adjustment of even a slight degree is possible. Furthermore, the color or size of the eye cannot be changed to correspond to the size of the animal cape or the preferences of the customer.

An important aspect of taxidermy modeling is the "look" of the finished animal. An experienced taxidermist can give a mounted animal a docile, alert or aggressive look by making subtle changes in the form, particularly the eye. The use of permanently preset eyes prevents the taxidermist from exercising this creativity in the creation of a particular mount. Also, the taxidermist may simply disagree subjectively with the "look" of the eyes as preset by the form manufacturer.

SUMMARY OF THE INVENTION

Therefore, it is an object of the invention to provide a taxidermy form having a preformed eye socket and an eye adapted for automatic alignment to an anatomically correct position and appearance.

It is another object of the present invention to provide an eye insert for a taxidermy form having a preformed eye socket, wherein the eye insert and eye socket cooperate to automatically align the eye insert to an anatomically correct position and appearance.

It is another object of the present invention to provide a taxidermy form and eye insert which enables the taxidermist to quickly and correctly apply the eye insert to the taxidermy form in an anatomically correct position.

It is another object of the present invention to provide a taxidermy form and eye insert which enables the taxidermist to apply his own subjective judgement to the precise appearance of the eye within the form by allowing slight adjustments in the position of the eye insert within the taxidermy form.

It is another object of the present invention to provide a taxidermy form and eye insert wherein a number of different sizes or types of eye inserts can be selected for use in a particular taxidermy form.

It is yet another object of the present invention to provide a taxidermy form which, while designed to accept a preformed eye insert, can nevertheless be used by a taxidermist to set an eye in a conventional manner using modeling compound and manual positioning of the eye.

These and other objects and advantages of the present invention are achieved in the preferred embodiment described below by providing a taxidermy form in the shape of a head of an animal having a shape of suitable contour for mounting a fur or skin thereon. The form defines an eye socket on either side of the head for placement of an eye insert. Alignment means cooperate with the eye insert and eye socket of the form for positioning the eye insert in a pre-determined alignment in the eye socket within a narrow range of adjustment. The eye insert according to the present invention includes an artificial eyeball and a base into which the eyeball is partially set. The base is configured to be positioned within the eye socket of a taxidermy form and fixed against substantial adjustment relative to the eye socket.

According to one embodiment of the invention, a fairing is carried by the base and overlaps both the eyeball and the taxidermy form immediately adjacent the eye socket so that the adjacent external surfaces of the eye insert and taxidermy form blend smoothly to define upper and lower eyelids and brow of an anatomically correct shape and appearance.

According to another embodiment of the present invention, the alignment means described above comprises one of the base or the eye socket defining a slot therein and a raised tab carried by the other of the base and eye socket. The raised tab is matingly positioned within the slot for establishing proper alignment of the eye insert within the eye socket and preventing substantial adjustment therebetween.

BRIEF DESCRIPTION OF THE DRAWINGS

Some of the objects of the invention have been set forth above. Other objects and advantages of the invention will appear as the description of the invention proceeds, when taken in conjunction with the following drawings, in which:

FIG. 4 is a front/side exploded view of a taxidermy form and two eye inserts according to the present invention;

FIG. 5 is a fragmentary, enlarged, cross-sectional, exploded view of an eye insert and the eye socket portion of the taxidermy form according to the present invention;

FIG. 6 is a perspective view of an eye insert according to the present invention; and, FIG. 7 is a completed animal mount utilizing an eye insert and taxidermy form according to the present invention.

DESCRIPTION OF THE PREFERRED EMBODIMENT

Figure 1:
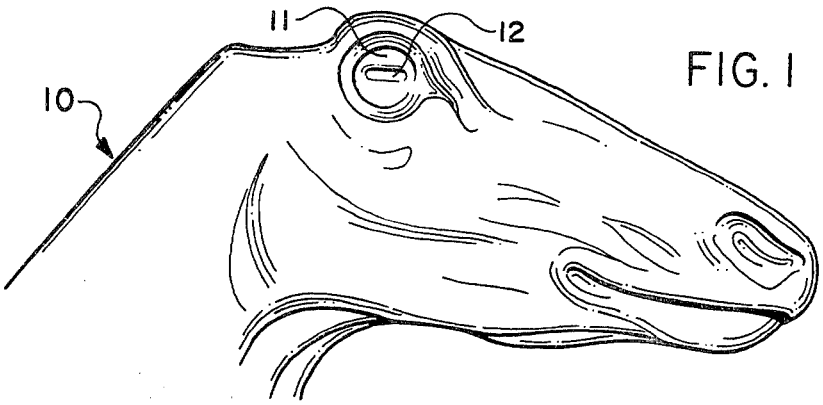
FIG. 1 is a side view of a head and upper neck portion taxidermy form of a white tail deer according to the present invention.

Referring now specifically to the drawings, a white tail deer taxidermy form is illustrated in FIG. 1 and designated at broad reference numeral 10. Taxidermy forms of this type are typically molded of high density polyurethane foam which is relatively light weight and yet has a high degree of structural integrity. In reality, the white tail deer form extends somewhat further down the neck where it is squared off and suitably fastened to a mounting board.

Figure 3:
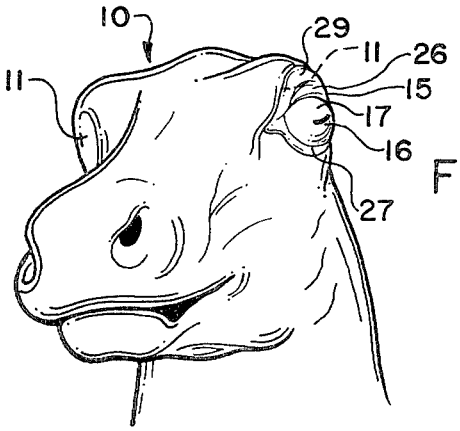
FIG. 3 shows a front/side view of the taxidermy form in FIG. 1 according to the present invention with an eye insert positioned in one of the two sockets.

Still referring to FIGS. 1 and 3, an eye socket 11 is formed on either side of taxidermy form 10. The eye socket 11 is shallower than that of a conventional corresponding form and has an innermost, outwardly facing surface which is substantially planar. An elongate slot 12 is molded into the eye socket 11 as will be explained in further detail below. An eye insert 15 is adapted to be positioned into the eye socket 11. As is best shown in FIG. 5, eye insert 15 comprises a glass eye 16 which is fabricated to look as realistic as possible and includes an outer, convex surface 17 and an inner, concave surface 18. Eye 16 is partially embedded in a base 20 which may suitably be constructed of high density polyurethane foam of a type similar or identical to that from which the taxidermy form itself is molded. The rear surface of base 20 is relatively planar and is adapted for mating surface-to-surface connection with the innermost, or facing, surface of eye socket 11 which is also substantially planar. An elongate tab 22 is integrally formed in the rear surface of base 20 and mates with slot 12 and fixes insert 15 against substantial adjustment relative to eye socket 12. Preferably, eye insert 15 is glued into eye socket 11 with a hot melt type of glue which is applied with a glue gun.

In order for the eye insert 15 to look as realistic as possible, a fairing 25 is preferably integrally formed with base 20 and, as is best shown in FIG. 5 and 6, overlaps both the glass eye 16 and the taxidermy form 10 immediately adjacent eye socket 11 so that the adjacent external surfaces blend smoothly to define an upper eyelid 26, a lower eyelid 27 and a brow 29.

Because of the close mating interrelationship between insert 15 and eye socket 11, substantial adjustment therebetween is prevented. However, slight adjustments can be made by carving or abrading the base 20 or fairing 25 to alter the position of the eye slightly. The amount of adjustmeent which is practically possible is sufficiently slight so that the anatomical correctness of the insert is not impaired. Yet, a skilled taxidermist can give several different "looks" to the form by adjusting the position of eye insert 15 in this manner.

Figure 2:
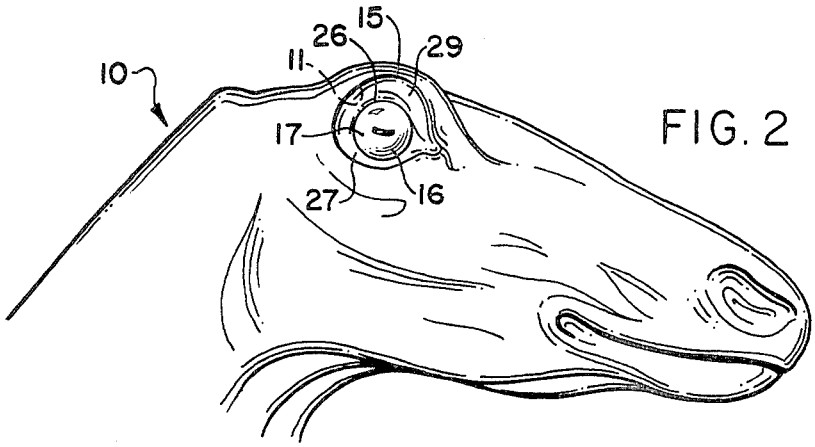
FIG. 2 shows the taxidermy form of FIG. 1 with the eye insert according to the present invention positioned within the eye socket.

Of course, base 20 and fairing 25 can be constructed of a variety of materials including more conventional modeling compounds such as plastic or acrylic based putty or sculpting material. Unlike taxidermy forms provided with preset eyes, subtle adjustment can be made to suit the individual taxidermist. Likewise, the taxidermist may use any of several available styles or colors of eyes to suit his judgement and the desires of the customer. FIG. 4 shows the manner in which the inserts are positioned into each of the eye sockets 11. FIG. 3 shows the contrast in appearance between the empty socket 11 and the socket 11 with insert 15 in place. FIG. 2 shows a side view of the taxidermy form 10 with the eye insert 15 in place. The finished product is illustrated in FIG. 7.

An eye insert for a taxidermy form and a taxidermy form having a preformed eye socket and an eye adapted for automatic alignment is described above. Various details of the invention may be changed without departing from its scope. Furthermore, the foregoing description of a preferred embodiment of the invention is provided for the purpose of illustration only and not for the purpose of limitation—the invention being defined by the claims.

I claim:

1. An eye insert for a taxidermy form having a preformed eye socket, wherein the eye insert and eye socket cooperate to automatically align the eye insert to an anatomically correct position and appearance while permitting a narrow range of adjustment of the insert relative to the socket, said eye insert comprising:

(a) an artificial eyeball;

(b) a base which is smaller than the eye socket opening and into which the eyeball is adapted to be partially set, said base configured to be positioned within the eye socket of the taxidermy form; and, (c) alignment means carried by said base and the eye socket for positioning the base in a predetermined alighment in the eye socket and for permitting the eye insert to be manually adjusted within the eye socket within a narrow range of adjustment in order to achieve a completely life-like appearance before being fixed against further movement.

2. An eye insert for a taxidermy form according to claim 1, and including a fairing carried by said base and overlapping both the eyeball and the taxidermy form immediately adjacent the eye socket so that the adjacent external surfaces of said eye insert and taxidermy form blend smoothly to define upper and lower eyelids and brow of an anatomically correct shape and appearance.

3. An eye insert according to claim 1, wherein said alignment means comprises a one of said base or said eye socket defining a slot therein and a raised tab carried by the other of said base and eye socket for being matingly positioned within the slot for establishing proper alignment of the eye insert within the eye socket and preventing substantial adjustment therebetween.

4. An eye insert according to claim 1, wherein a rear surface of said base and the innermost surface of the taxidermy form defining the eye socket are each substantially planar and are adapted for mating surface-to-surface connection.

5. An eye insert for a taxidermy form having a preformed eye socket, wherein the eye insert and eye socket cooperate to automatically align the eye insert to an anatomically correct position and appearance, said eye insert comprising:

(a) an artificial eyeball;

(b) a base which is smaller than the eye socket opening and into which the eyeball is adapted to be partially set, said base configured to be positioned within the eye socket of the taxidermy form, a rear surface of said base and the innermost surface of the taxidermy form defining the eye socket being each substantially planar;

(c) alignment means carried by said base and the eye socket positioning the base in a pre-determined alighment within the eye socket within a narrow range of adjustment, said alignment means comprising a one of said base or said eye socket defining a slot therein and a raised tab carried by the other of said base and eye socket for being matingly positioned within the slot for establishing proper alignment of the eye insert within the eye socket and permitting the eye insert to be manually adjusted within the eye socket within a narrow range of adjustment in order to achieve a completely life-like appearance before being fixed against a further movement.

6. An eye insert for a taxidermy form according to claim 5, and including a fairing carried by said base and overlapping both the eyeball and the taxidermy form immediately adjacent the eye socket so that the adjacent external surfaces of said eye insert and taxidermy form blend smoothly to define upper and lower eyelides and brow of an anatomically correct shape and appearance.

7. A taxidermy form having a preformed eye socket and an eye adapted for automatic alignment to an anatomically correct position and appearance, said taxidermy form comprising:

(a) a form in the shape of a head of an animal having a shape of suitable contour for mounting a fur or skin thereon;

(b) said form defining an eye socket on either side of the head thereof for placement of an eye insert;

(c) said eye insert comprising an artificial eyeball;

(d) a base which is smaller than the eye socket opening and into which the eyeball is adapted to be partially set, said base configured to be positioned within the eye socket of the taxidermy form; and (3) alignment means carried by said base and the eye socket for positioning the base in a predetermined alignment in the eye socket and for permitting the eye insert to be manually adjusted within the eye socket within a narrow range of adjustment in order to achieve a completely life-like appearance before being fixed against further movement.

8. A taxidermy form according to claim 1, which also comprises a fairing carried by said base and overlapping both the eyeball and the taxidermy form immediately adjacent the eye socket so that the adjacent external surfaces of said eye insert and taxidermy form blend smoothly to define upper and lower eyelids and brow of an anatomically correct shape and appearance.

9. A taxidermy form according to claim 7, wherein said alignment means comprises a one of said base or said eye socket defining a slot therein and a raised tab carried by the other of said base and eye socket for being matingly positioned with the slot for establishing proper alignment of the eye insert within the eye socket and preventing substantial adjustment therebetween.

* * * * *

UNITED STATES PATENT AND TRADEMARK OFFICE

CERTIFICATE OF CORRECTION

PATENT NO. : 4,477,500

DATED : October 16, 1984

INVENTOR(S) : Leon T. Powell

It is certified that error appears in the above-identified patent and that said Letters Patent are hereby corrected as shown below:

Column 5, line 15, "alighment" should read --alignment--.

Column 5, line 54, "alighment" should read --alignment--.

Column 6, line 40, "according to claim 1" should read --according to claim 7--.

Signed and Sealed this

Tenth Day of September 1985

[SEAL]

*Attest:*

DONALD J. QUIGG

*Attesting Officer* *Acting Commissioner of Patents and Trademarks - Designate*